US005638625A

United States Patent [19]

Ilkka et al.

[11] Patent Number: 5,638,625

[45] Date of Patent: Jun. 17, 1997

[54] INFORMATION BOARD

[75] Inventors: Petri Ilkka, Kyröskoski; Matti Piipponen, Tampere, both of Finland

[73] Assignee: Baron Tech OY, Pirkkala, Finland

[21] Appl. No.: 513,988

[22] PCT Filed: Mar. 15, 1994

[86] PCT No.: PCT/FI94/00095

§ 371 Date: Oct. 30, 1995

§ 102(e) Date: Oct. 30, 1995

[87] PCT Pub. No.: WO94/22126

PCT Pub. Date: Sep. 29, 1994

[30] Foreign Application Priority Data

Mar. 15, 1993 [FI] Finland ..... U930149

[51] Int. Cl.[6] ..... G09F 11/18

[52] U.S. Cl. ..... 40/471

[58] Field of Search ..... 40/471; 192/48.92, 192/97; 74/371, 372

[56] References Cited

U.S. PATENT DOCUMENTS

| | | | |
|---|---|---|---|
| 1,773,490 | 8/1930 | Larsen | 74/372 X |
| 1,884,595 | 10/1932 | Moxley | 74/371 |
| 2,072,058 | 2/1937 | Rauen | 192/48.92 X |
| 3,685,621 | 8/1972 | Gulick et al. | 192/48.92 |
| 3,854,561 | 12/1974 | Conde | 192/48.92 |
| 4,741,118 | 5/1988 | Aiken et al. | 40/471 X |
| 5,265,707 | 11/1993 | Abe et al. | 192/48.92 X |

*Primary Examiner*—Joanne Silbermann

*Attorney, Agent, or Firm*—Larson and Taylor

[57] ABSTRACT

An information board includes display bands having information printed thereon mounted on wind-up rolls, the wind-up rolls being mounted on an axle. A wind-up motor is used to rotate the axle when the motor is rotated in a first direction to wind-up a display band, thereby changing the information shown on the display band. The information board further includes a mechanism which changes the rotational motion of the motor, when rotated in the opposite direction, to axial motion for moving the axle axially. Coupling elements are mounted on the axle to engage a selected wind-up roll when the axle is moved in the axial direction.

4 Claims, 3 Drawing Sheets

A — A

INFORMATION BOARD

FIELD OF THE INVENTION

The invention relates to an information board with many adjacent displays that are independently changeable by winding up a new information symbol to replace a former display.

BACKGROUND OF THE INVENTION

Previously information boards are known, which are furnished for instance with FIGS. 0–9 on a rotatable drum, whereby the wanted figure can be rolled up on the display. There are several adjoining displays to show prices of commodities, results of athletic contests or letters for words. Motors or stepping motors have been used to rotate the drums in order to roll them one symbol at a time.

Drums of this kind are space-taking, since a drum containing the FIGS. 0–9 must be ten-cornered if the displays are levels.

SUMMARY OF THE INVENTION

With the information board as per this invention the former disadvantages are solved and the invention is characterized in what is presented in the patent claims.

The most significant advantage of the invention can be considered the fact that the board outer measures can be made very close to the measures required by the displays, the thinness of board and simple actuators, by means of which changing of displays can be arranged with a small number of components. The construction of board and displays allows the lighting fixtures to be fitted inside the board, whereby they illuminate the displays from behind without producing any shadow areas on the displays. The display band is translucent securing the visibility of symbols on the band.

BRIEF DESCRIPTION OF THE DRAWINGS

In the following the invention is described in detail with reference to the enclosed drawing, where.

DETAILED DESCRIPTION OF THE PREFERRED EMBODIMENTS

Figure 1:
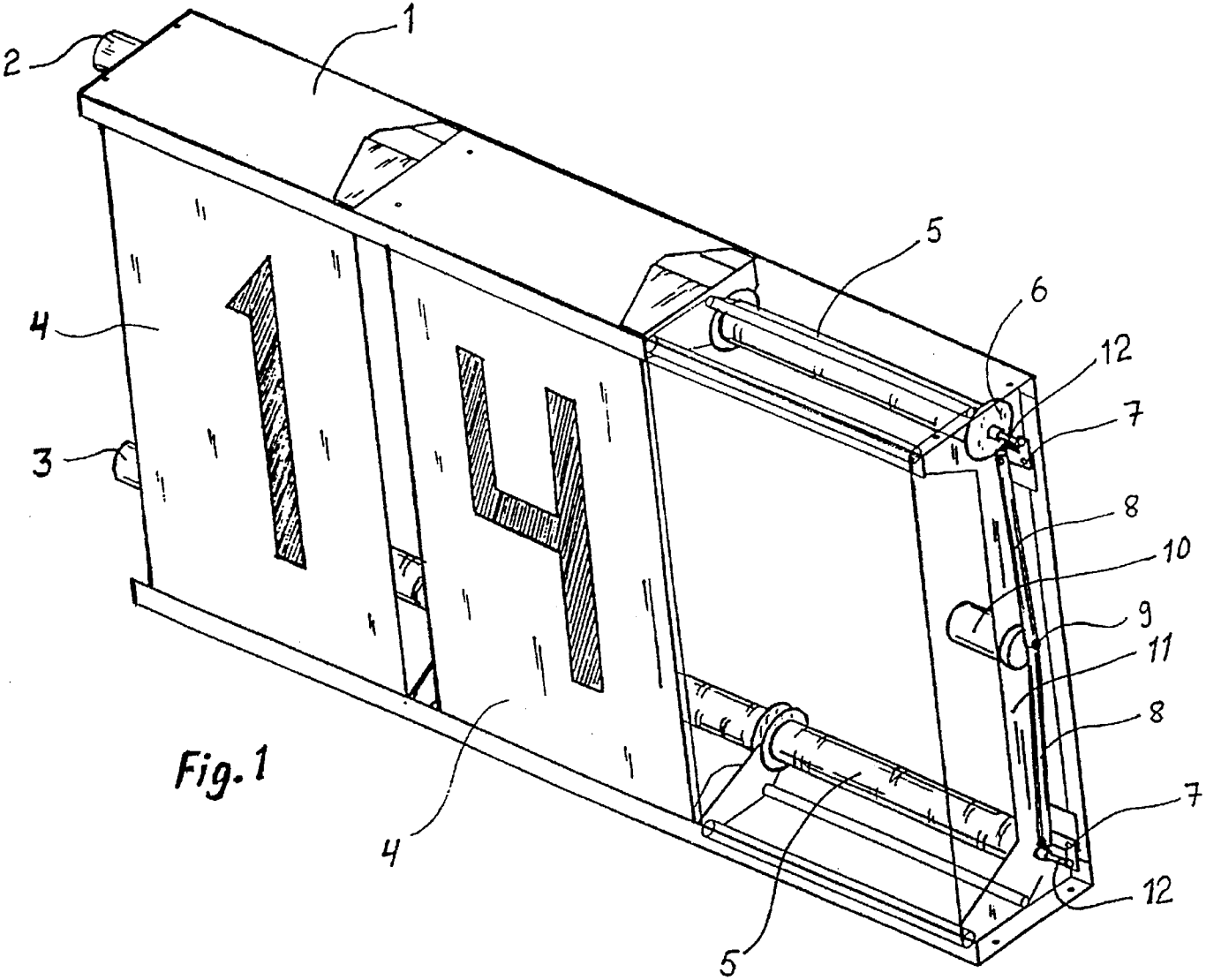
FIG. 1 is a diagonal view of a partially sectioned information board

FIG. 1 shows an information board with three displays in a box 1, where the displays 4 are on a rotatable band. In the box there are upper wind up rolls 5 and lower wind-up rolls 5 for each of the three display bands. In the exemplary solution the display bands can be wound-up both ways, to the upper rolls and to the lower rolls. Accordingly, all drums are wind-up rolls. The upper rolls are rotated by a motor 2 and the lower ones by another motor 3. The display bands are made of flexibe heavy-duty material, onto which symbols can be printed. Through both roll systems 12 an axle is taken and these axles are rotated by motors 2 and 3. The axles can move, longitudinally, certain distance and three different restricted positions are arranged for them by means of a mechanism built of rockers 7, arms 8 and a motor 10. A crank arm rotated by a motor 10 produces a to-and-fro motion to arms 8. By means of restrictors the motor 10 is stopped in three different positions, whereby axles 12 can be moved, similarly, to three different positions in their lengthwise direction by motor 10. Winding-up the display bands both ways is arranged by two motors and the transmission mechanism of axles 12 is actuated by a further motor 10. It is possible to add further adjoining displays, then only the number of the motor 10 stopping positions has to be increased in order to match with the number of adjacent displays. The lighting fixtures are placed in the free space in the box behind the display bands, where they freely illuminate the display from behind and a part of the light has exit out over the display bands producing illumination for the displays.

Figures 2, 3:
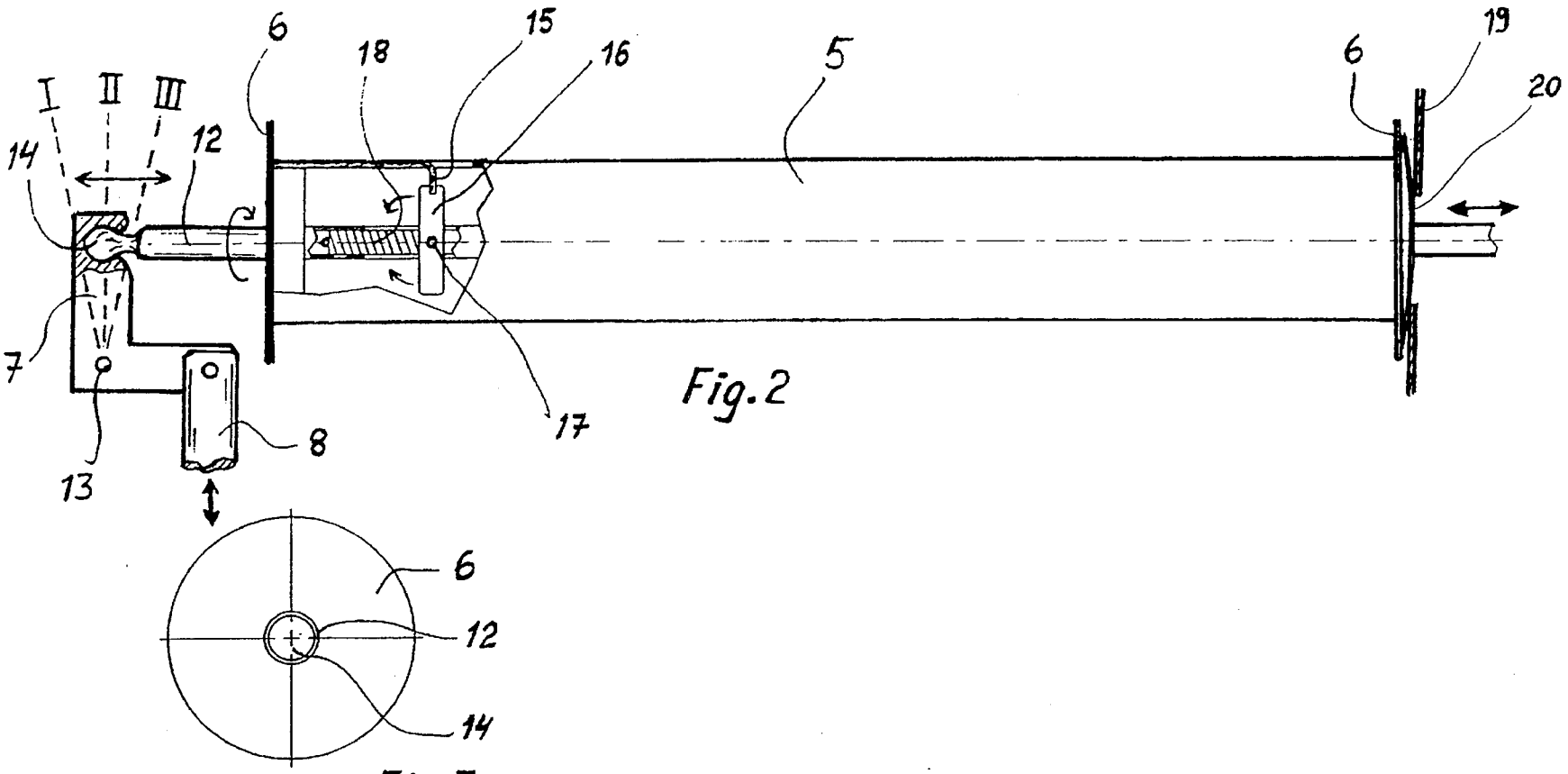
FIG. 2 is a partially sectioned wind-up roll
FIG. 3 is a wind-up roll viewed from one end

FIG. 2 shows a wind-up roll 5 with a sectional view of its intern. Axle 12 runs inside all the three adjacent wind-up rolls and axles 12 are rotated, upon need, by motors 2 and 3. In the figure the rotation mechanism of wind-up rolls 5 is in position II, whereby the wind-up roll in the figure rotates along with axle 12. In axle 12 there is an oblong hole, in the centre of which a wing 16 is fastened by a fulcrum pin 17 so that the rotating wing hits coupling part 15, which is bent to the inside from the wind-up roll surface, and starts to rotate the wind-up roll, too. In position II only one of axle 12 wings 16 hits coupling part 15 of the wind-up rolls. Similarly, in positions I and III the other wind-up rolls (not shown) start to rotate in their turn by their own wing 16. Thereby, wing 16 in the wind-up roll in FIG. 2 moves off the coupling part 15. Wing 16 is kept upright by spring 18 so that it hits coupling part 15 on reaching it. The wing can bend in the hole if it happens to hit part 15 during the travel of the axle.

A solution of the lever mechanism of the axle 12 moving mechanism is shown furnished with a ball 14 at the axle end. Rocker 7 is articulated to the board frame 11 from joint point 13. By means of arm 8 the motion is brought to rocker 7, whereby there are on axle 12 the determined three positions, each of them corresponding to the situation that one of its three wings 16 is in a wind-up roll winding the roller and in two other rolls the wing is beside the coupling part 15.

Between the upper and the lower rolls the wings 16 are so arranged that they are not simultaneously activating the same display band, which means that if the upper roll wing 16 is winding-up, the corresponding lower wind-up roll wing 16 is in neutral position.

FIG. 3 is a wind-up roll viewed from the end. The roll has a collar 6 to steer the band while winding it up.

The winding-up can also be arranged with only one set of rolls, e.g. upper rolls. Thereby the band is endless, such that it is wound-up in the box and rolled up only one way. Winding up both ways is possible with one wind-up roll if the display portion of the band can be tensioned by any appropriate means.

Figure 4:
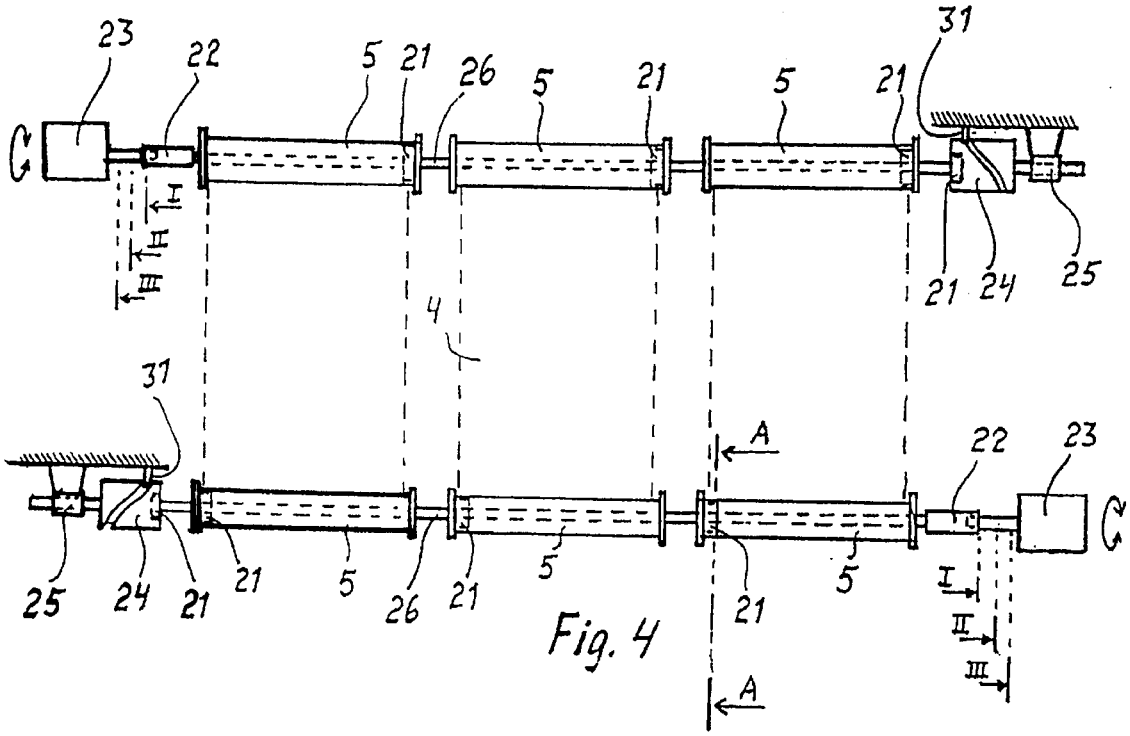
FIG. 4 is another embodiment for longitudinal motion of axles

FIG. 4 shows the axial motion of axles 26 accomplished by using the same motor 23, by means of which axle 26 is also rotated. Axle 26, associated with the upper roll system 5, transmits axial motion to positions I, II and III when motor 23 is rotating and part 24, which has a spiral orbit and is fastened to axle 26, is steered to axial motion by fixed pin 31. By means of one-way clutch 21 axle 26 is connected to part 24 and with this direction of motor 23 rotation the one-way clutch is switched on and rotating part 24. By means of sensors, e.g. an approach clutch, motor 23 can be stopped in three different spots, such that axle 26 can be moved to corresponding positions I, II and III. Each position corresponds to one of the wind-up positions of the upper rolls 5. The motor is steered to stop in a wanted position according to the roll 5 one wants to rotate. Winding up the wanted roll is done by rotating motor 23 in reversed direction, whereby part 24 does not start to rotate due to one-way clutch 21. Instead, roll 5 starts to rotate due to the one-way clutch functioning in the reverse direction in this roll 5. Motor 23 is rotated till the wanted symbol is in its appropriate position. The two other rolls 5 do not rotate, since by their one-way clutch 21 there is in axle 25 no coupling element 30. The next adjoining roll is rotated by similar direction of motor rotation when the motor has first been rotated in the reverse direction till axle 26 has moved, longitudinally, to position II or III. Each roll has its own one-way clutch 21 and for each one-way clutch 21 there is a coupling element 30 in axle 23 so that the presence of one coupling element 30 by one one-way coupling 21 always corresponds to axle positions I, II and III. Rolls 5 do not move axially but can rotate in their location only. At the end of axles 26 there is a bushing 22 that transmits rotation. This bushing can glide on the motor axle. In the example the lower rolls are rotated in the same way such that, by means of the same, bands 4 suspended on rolls 5 are rotated in the reverse direction to the upper rollers. Positions I, II and III of the upper axle are switched on with the corresponding lower axle so that the coupling elements 30 of axles 26 in the one-way clutches 21 of the upper and lower rolls of one band are never at the same time by their one-way clutches but allow roll 5 to rotate freely.

Figure 5:
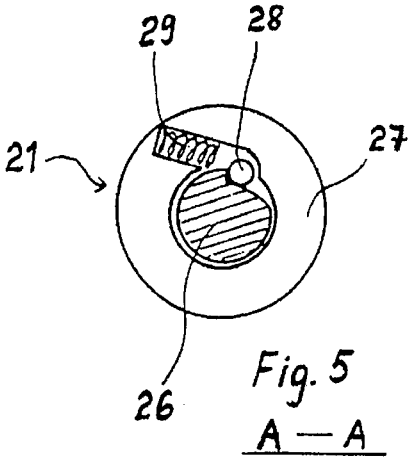
FIG. 5 is a cross section of a one-way clutch

FIG. 5 shows the construction of a one-way clutch 21, where the clockwise axle rotation rotates the one-way clutch body 27 by means of a ball 28 and thus also roll 5 or part 24. The reverse axle rotation forces the ball against spring 29 and the clutch body does not start to rotate.

Figure 6:
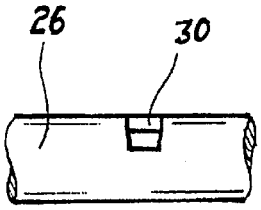
FIG. 6 is a side view of an axle with a slot

FIG. 6 shows the front view of a slot on axle 26 surface with the function of a coupling element. Ball 28 fits into the slot to prevent rotation.

We claim:

1. An information board comprising:

display bands having information printed thereon;

a box having an opening in a front side for displaying at least a portion of the information printed on said display bands;

a first axle extending across a width of said box adjacent at top or bottom end thereof;

a first set of wind-up rolls mounted on said first axle, each of said display bands being coupled to a respective one of said first set of wind-up rolls and attached to means adjacent the other of the top and bottom ends of said box for holding said display bands in place between top and bottom ends of said box such that said display bands can be wound to change the information displayed in said box; and at least one wind-up motor for rotating said first axle in a forward direction and in a reverse direction; and first coupling means for individually coupling a selected one of said first set of wind-up rolls to said wind-up motor to wind the display band coupled thereto thereby changing the information displayed in said box, said first coupling means being mounted on said first axle and comprising:

a plurality of coupling elements, each corresponding to a respective one of said first set of wind-up rolls and mounted on said first axle for coupling a selected wind-up roll to said first axle to wind-up a respective display band, means for changing rotational motion of said first axle to axial motion, and one-way clutches mounted on said first axle for engaging said means for changing rotational motion with said first axle when said wind-up motor is rotated in one of said forward and reverse directions for moving any one of said coupling elements into or out of engagement with a selected one of said first set of wind-up rolls to respectively couple or uncouple said selected wind-up roll to said first axle, said one-way clutches disengaging said means for changing rotational motion when said wind-up motor is rotated in the other of said forward and reverse directions.

2. The information display board according to claim 1 wherein said means for holding said display bands comprises a second axle having a second set of wind-up rolls corresponding to said first set of wind-up rolls mounted thereon, each of said display bands being coupled to a respective one of said first set of wind-up rolls and a corresponding one of said second set of wind-up rolls such that said display bands can be wound to change the information displayed in said box, said information display board further including second coupling means, mounted on said second axle, for individually coupling a selected one of said second set of wind-up rolls to said wind-up motor, said second coupling means comprising:

a plurality of coupling elements, each corresponding to a respective one of said second set of wind-up rolls and mounted on said second axle for coupling a selected wind-up roll to said second axle to wind-up a respective display band, means for changing rotational motion of said second axle to axial motion, and one-way clutches mounted on said second axle for engaging said means for changing rotational motion with said second axle when said wind-up motor is rotated in one of said forward and reverse directions for moving any one of said coupling elements into or of engagement with a selected one of said second set of wind-up rolls to respectively couple or uncouple said selected wind-up roll to said second axle, said one-way clutches disengaging said means for changing rotational motion when said wind-up motor is rotated in the other of said forward and reverse directions.

3. The information display board according to claim 2 wherein said first coupling means is mounted to rotate said display bands in one of an upward direction and a downward direction and said second coupling means is mounted to rotate said display bands in the other of said upward and downward directions.

4. The information board according to claim 1 wherein said means for changing rotational motion comprises a helix or a thread having a fixed counterpart in said box for forcing said axle into axial motion while rotating.

* * * * *